US005571420A

United States Patent [19]

Creeron et al.

[11] Patent Number: 5,571,420

[45] Date of Patent: Nov. 5, 1996

[54] COOLING SYSTEM CHANGE OVER APPARATUS AND PROCESS

[75] Inventors: Richard F. Creeron, Valley Stream, N.Y.; Aleksei V. Gershun, Danbury, Conn.; Stephen M. Woodward, Lakeside, Conn.; Peter M. Woyciesjes, Woodbury, Conn.

[73] Assignee: Prestone Products Corporation, Danbury, Conn.

[21] Appl. No.: 431,494

[22] Filed: Feb. 13, 1995

Related U.S. Application Data

[63] Continuation of Ser. No. 751,411, Aug. 28, 1991, abandoned.

[51] Int. Cl.[6] ..... C02F 1/62; C02F 1/28; C02F 1/42

[52] U.S. Cl. ..... 210/665; 210/666; 210/668; 210/669; 210/688; 210/694; 210/724; 210/732; 123/41.14; 134/22.1; 134/22.18

[58] Field of Search ..... 210/665, 666, 210/668, 669, 688, 694, 712, 723, 724, 732, 776, 912, 167; 123/41.14; 165/95; 134/22.1, 22.18

[56] References Cited

U.S. PATENT DOCUMENTS

| | | | |
|---|---|---|---|
| 2,029,232 | 1/1936 | Green | 165/95 |
| 4,293,031 | 10/1981 | Babish et al. | 165/95 |
| 4,791,890 | 12/1988 | Miles et al. | 165/95 |
| 4,840,223 | 6/1989 | Lee | 165/95 |
| 4,901,786 | 2/1990 | Vaturu et al. | 165/95 |
| 4,946,595 | 8/1990 | Miller, Jr. | 210/758 |
| 5,078,866 | 1/1992 | Filowitz et al. | 165/95 |
| 5,094,757 | 3/1992 | Light | 165/95 |
| 5,097,894 | 3/1992 | Cassia | 165/95 |
| 5,223,144 | 6/1993 | Woyciesjes et al. | 210/664 |

*Primary Examiner*—Neil McCarthy
*Attorney, Agent, or Firm*—Cummings & Lockwood

[57] ABSTRACT

A change-over apparatus for use in conjunction with a cooling system of an internal combustion engine having an engine and radiator and having an upper hose between the radiator and the engine which has been cut to form an upper radiator hose section and an upper engine hose section wherein a change-over apparatus comprising at least one tubular body having first and second tube bodies having end openings, with the end opening for connection to said upper radiator hose section, said second end opening for connection to said upper engine hose section, a liquid ingress opening spaced from said first end opening, a liquid egress opening spaced from said second end opening, and, optionally, a flow regulating means placed between said liquid ingress opening and said liquid egress opening.

29 Claims, 4 Drawing Sheets

COOLING SYSTEM CHANGE OVER APPARATUS AND PROCESS

This application is a continuation of application Ser. No. 751,411, filed Aug. 28, 1991, now abandoned.

FIELD OF THE INVENTION

The invention relates to an automotive cooling system change-over apparatus and process operated in the normal flow direction through the radiator of the automotive cooling system while the automobile is running. After the upper radiator hose is cut or one end removed and a antifreeze/coolant volume is introduced at the upper hose segment of the radiator by means of a change-over apparatus, a substantially equal volume of liquid in the cooling system is removed via the section of the upper hose connected to the engine.

BACKGROUND OF THE INVENTION

The prior art related to the flushing and filling automotive radiators and cooling systems is filled with diverse methods and apparatae for use in removing used antifreeze/coolant and replacing such with new antifreeze/coolant. Although numerous methods and apparatus have been devised to accomplish this process, such have had certain common and limiting features associated with the removal and introduction of antifreeze/coolant from and to the automotive cooling system. For example, "change-over" of a cooling system from used antifreeze/coolant to new antifreeze/coolant has generally involved the introduction of a flushing liquid or new antifreeze/coolant at the opening associated with the radiator cap while a second opening, typically an opening in the engine, is present in the automotive cooling system for the removal of the spent antifreeze/coolant. The second opening may be the drain plug at the bottom of the radiator or may be an opening formed by cutting or removing one of the hoses found in the automotive cooling system. Although the aforementioned general flush/fill process has been used for many years, this process is not without its problems. For example, when the second opening is the drain plug the contents of the cooling system actually flushed is generally only a portion of the total volume of the cooling system, since the thermostat in the automotive cooling system generally remains closed when in contact with the cool flushing water and, further, some of the antifreeze/coolant is trapped in the engine. Further, the new antifreeze/coolant is added to the cooling system and is necessarily admixed and contaminated with a significant amount of the old antifreeze/coolant.

A prior art search in the U.S. Patent and Trademark Office located the following patents relating to antifreeze/coolant change-over processes:

| U.S. Pat. No. | PATENTEE |
|---|---|
| 1,969,295 | Davis |
| 3,094,131 | Williams |
| 3,180,759 | Falk |
| 3,188,006 | Falk |
| 3,409,218 | Moyer |
| 4,083,399 | Babish et al. |
| 4,109,703 | Babish et al. |
| 4,127,160 | Joffe |
| 4,161,979 | Stearns |
| 4,176,708 | |
| 4,209,063 | Babish et al. |
| 4,293,031 | Babish et al. |
| 4,790,882 | Barnes |

-continued

| U.S. Pat. No. | PATENTEE |
|---|---|
| 4,791,890 | Miles et al. |
| 4,793,403 | |
| 4,899,807 | Joffe |
| 4,901,786 | Vataru et al. |

U.S. Pat. Nos. 4,083,399, 4,109,703, 4,127,160, 4,176,708, 4,209,063 and 4,293,031 disclose apparatuses for use in flushing an engine cooling system. These patents require the use of a complicated, console controlled, flushing apparatus which utilizes water pump, vehicle heater and radiator connections in order to provide a controlled pressurized flow of flushing liquid and entrained gas bubbles through the automotive cooling system. As in the '399 patent, the flushing systems in the '703, '063, and '031 patents pass the flow of flushing liquid through the radiator in first a reverse direction and then a forward direction. The remaining two patents ('160 and '708 patents) are concerned with the series of branch conduits and/or valving used in the flushing system.

U.S. Pat. Nos. 4,791,890, 4,793,403, 4,899,807 and 4,901,786 disclose engine coolant flushing and filtering systems wherein the coolant flushed from the vehicle radiator is filtered and then recirculated back into the system.

U.S. Pat. Nos. 1,969,295, 3,188,006 and 3,409,218 all disclose radiator flushing systems which utilize T-connections and valving similar to that disclosed in U.S. Pat. No. 4,790,882. The '295 patent utilizes a T-connection valve between cut portions of the lower supply hose between an engine and the radiator. Relative to the '295patent, the '006 and '218 patents disclose much more complicated flushing systems and neither of these patents sever the upper radiator hose in order to perform the flushing operation.

Another consideration involved in the change-over of used antifreeze/coolant from an automotive cooling system is the volume of used antifreeze/coolant and flushing liquids which result from the change-over process. Since most prior art processes involve draining the used antifreeze/coolant and the use of copious amounts of water as a flushing liquid, the net result of such prior art processes is the accumulation of a large volume of a mixture of the used antifreeze/coolant mixed with the water used as the flushing liquids. Since it is desirous to dispose of the resulting liquid in an environmentally responsible manner, preferably by recycle of the ethylene glycol of the used antifreeze/coolant, the generation of large volumes of liquid with high water content is undesirable. Unfortunately, the mixture liquids in such processes for the change-over of used antifreeze/coolant result in a liquid to be recycled containing up to about 90 weight percent water. Since a major cost in the recycle of the ethylene glycol in the used antifreeze/coolant is the removal of water, it is most advantageous to have a liquid for recycle which has as great a weight percent ethylene glycol as possible. This is to be contrasted with the used antifreeze/coolant which typically contains about 50 weight percent water.

The instant invention overcomes many of the problems associated with the prior art flush/fill process by providing a simple easy to use antifreeze/coolant change-over apparatus and process. A change-over apparatus and process is employed to facilitate removal of used antifreeze/coolant from a cooling system in conjunction with the introduction of new antifreeze/coolant.

SUMMARY OF THE INVENTION

Figure 1:
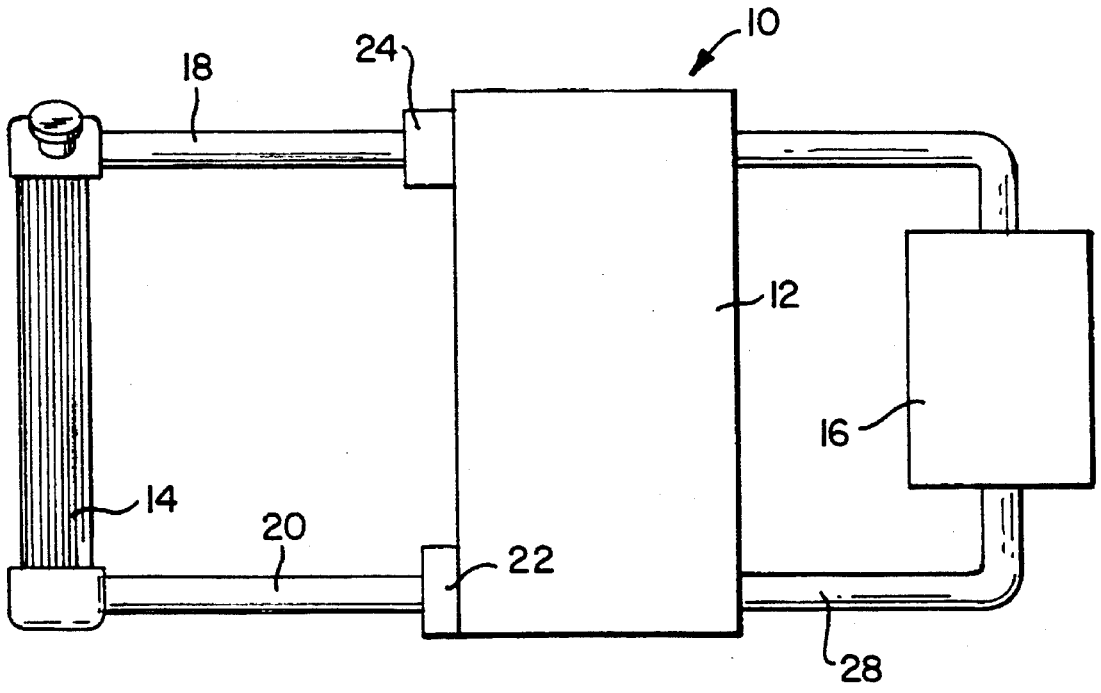
FIG. 1 is a perspective view of an automotive cooling system comprising the engine, thermostat, water pump, radiator hoses, heater hoses and radiator.

The instant invention relates to a cooling system change-over apparatus and process for use with a cooling system having an engine and a radiator, wherein the apparatus is a flow directing apparatus for use in conjunction with a vehicle's cooling system having an upper radiator hose between the radiator and the engine which has been cut (or disconnected at either the radiator and/or engine) to form an upper radiator hose section and an upper engine hose section. The change-over apparatus comprises at least one tubular body having first and second end openings, said first end opening for connection to said upper radiator hose section, said second end opening for connection to said upper engine hose section, a third liquid ingress opening spaced from said first end opening, a fourth liquid egress opening spaced from said second end opening and, optionally, a flow regulating means placed between said liquid ingress opening and said liquid egress opening when the change-over apparatus is provided as a singular tubular body.

DETAILED DESCRIPTION OF THE INVENTION

In its broadest sense, the instant invention relates to a cooling system change-over apparatus for use in combination with a cooling system of an internal combustion engine ("cooling system"), preferably an automotive cooling system, having an engine and a radiator wherein the radiator and engine are connected by an upper radiator hose, a lower radiator hose and the cooling system has a water pump and a thermostat. In addition, the engine of the cooling system will generally also be in communication with a heater. The instant change-over apparatus comprises a change-over apparatus for use in conjunction with a cooling system having an engine and radiator and having an upper radiator hose between the radiator and the engine which has been cut to form an upper radiator hose section and an upper engine hose section wherein in one embodiment the change-over apparatus comprises an assembly having a tubular body having first and second end openings, the first end opening for connection to the upper radiator hose section, the second end opening for connection to the upper engine hose section, a liquid ingress opening spaced from the first end opening, a liquid egress opening spaced from the second end opening and, optionally, a flow regulating means placed between the liquid ingress opening and the liquid egress opening. In one embodiment the upper radiator hose is disconnected at the radiator and/or engine and the opening to the radiator and/or engine without a hose section is functionally equivalent herein to an upper radiator hose section and/or upper engine hose section. In a further embodiment the change-over apparatus comprises two tubular bodies wherein one tubular body has a first opening for connection to the upper radiator hose section and a liquid ingress opening for introduction of a liquid to the cooling system and a second tubular body for connection to the upper engine hose section and a liquid egress opening for removal of liquid from the cooling system.

The instant invention relates to a cooling system change-over process for use with a cooling system containing a first liquid having an engine and a radiator wherein the cooling system change-over apparatus comprises an apparatus for use in combination with a cooling system having an upper radiator hose between the radiator and the engine which has been cut to form an upper radiator hose section and an upper engine hose section. The change-over apparatus is characterized as at least being a tubular body and has a first and second end opening, said first end opening for connection to said upper radiator hose section, said second end opening for connection to said upper engine hose section, a liquid ingress opening spaced from said first end opening, a liquid egress opening spaced from said second end opening and when a singular tubular body is employed a flow regulating means placed between said liquid ingress opening and said liquid egress opening. The change-over apparatus may be employed in a process for replacing used antifreeze/coolant in a cooling system wherein the process comprises:

a) cutting the upper radiator hose of the automotive cooling system to provide an upper radiator hose section and an upper engine hose section;

b) providing said change-over apparatus for attachment to the upper radiator hose section and the upper engine hose section;

c) attaching the first end opening of the change-over apparatus to the upper radiator hose section;

d) attaching the second end opening of the change-over apparatus to the upper engine hose section;

e) providing a source of a second liquid to the liquid ingress opening;

f) providing a liquid collecting means to the liquid egress opening for collection of the first liquid in the cooling system;

g) running the vehicle having the cooling system until an amount of the second liquid from the source of second liquid has displaced an amount of first liquid from said cooling system to said collection means;

h) ceasing the running of the vehicle; and i) connecting the upper radiator hose section and upper engine hose section by means of connecting means.

The instant change-over apparatus and change-over process may be employed for the change-over of any first liquid in the cooling system with a second liquid. Further, the change-over process may be repeated any number of times where the second liquid becomes the "first liquid" of the cooling system and another liquid is employed as the "second liquid". For example, in one embodiment the cooling system will contain a first liquid which is a used antifreeze/coolant containing 30 to 70 weight percent ethylene glycol. The reference to "used antifreeze/coolant" herein denotes an antifreeze/coolant having undergone a period of use in a cooling system. The second liquid may be a change-over liquid comprising water and, optionally, a change-over agent. The change-over liquid acts as a cleaning liquid for the cooling system. After the change-over liquid is introduced into the cooling system the engine is run for a selected time to circulate the change-over liquid through the cooling system. During the period during which the change-over liquid is circulated through the cooling system the flow regulating means, if employed, is maintained in the open position and the liquid ingress opening and liquid egress opening are closed. Alternatively, the upper radiator hose section and upper engine hose section may be reconnected by a hollow connecting tube ("connecting means") after removal of the change-over apparatus. After the flushing liquid has circulated through the cooling system for a selected time the instant process may be repeated to displace the flushing liquid from the cooling system with a neutral liquid, such as water, or with a new antifreeze/coolant. In a further embodiment, the instant change-over process may be repeated two or more additional times whereby a neutral liquid displaces the flushing liquid one or more times followed by displacement of the neutral liquid by a new antifreeze/coolant. In the above-described manner any number of liquids may be sequentially introduced into the cooling system.

The instant change-over process is advantageous in that the only engine hose which needs to be cut is the upper radiator hose and that no petcock or drain opening needs to be located. Further, of the many engine hoses to be located the upper radiator hose is easily located as compared to other engine hoses. The complete antifreeze/coolant change-over process takes place using the change-over apparatus, the cooling system, a source for a second liquid and collection means for the first liquid in the cooling system. The instant change-over process enables removal of used antifreeze/coolant from a cooling system ("system") and introduction of a new antifreeze/coolant to the automotive cooling system in a quick and efficient manner which enhances the quality of the collected liquids for reclamation of the ethylene glycol content. The time frame for the fluid replacement process of the instant invention is generally less than about twenty (20) minutes.

This change-over (commonly referred to as a "flush/fill") process is new, novel, efficient, easily accomplished and improves the quality of the effluent obtained from the change-over process by reducing the volume of water present in the collected used antifreeze/coolant. The procedure is initiated and carried out when the vehicle is warm and, accordingly, when the thermostat is open but when the engine is not running or when the thermostat is removed. Because the cooling system is warm and may be under pressure, the operator carrying out the process must be protected from possible burns from hot liquids under pressure in the cooling system. The temperature of the cooling system may be determined by checking the upper radiator hose connected to the cooling system for temperature and pressure. If the hose is hard and warm, the hose is probably under pressure.

Although the pressure of the cooling system may be vented via the radiator cap, the use of a pressure relief device as described in copending U.S. Ser. No. (Attorney Docket No. 15615 and entitled "PRESSURE RELIEF DEVICE FOR AUTOMOTIVE COOLING SYSTEM" filed on even date herewith) is particularly advantageous, said application incorporated herein by reference hereto. The aforementioned pressure relief device comprises a hollow tube with a sharp point on one end with a hole set back from the sharp point, a penetration stop bar and a hollow delivery tube attached to the other end for transfer of liquid to a collection container. The pressure relief device is employed by penetrating the upper radiator hose with the sharp point of the hollow tube a distance determined by the stop bar such that the hole is placed inside the hollow area of the upper radiator hose while only a single hole is made in the hose. If the cooling system is under pressure liquid from the cooling system will pass through the hole in the hollow tube and out the hollow delivery tube to a collection container. Once liquid is no longer discharged from the hollow delivery tube, the pressure of the liquid in the cooling system will have been decreased to substantially ambient pressure. At this time the upper radiator hose may be cut or disconnected to provide for installation of the change-over apparatus of the instant invention.

One advantage of the instant invention is that it is well suited for all types of radiators (e.g., cross-flow and down-flow) currently associated with automobiles and light trucks.

Having thereby described the subject matter of this invention, it should be obvious that many substitutions, modifications, variations, and reversal of parts are possible in light of the above teachings. It is therefore to be understood that the invention as taught and described herein, is only to be limited to the extent of the breadth and scope of the appended claims.

In FIG. 1 an automotive cooling system 10 is shown having engine 12 radiator 14 and heater 16. Radiator 14 and engine 12 are connected by upper radiator hose 18 and lower radiator hose 20. The cooling system has water pump 22 which causes the liquid in the cooling system to travel in a down-flow direction through the radiator when the engine of the automobile is running. Further, the cooling system has a thermostat 24 which is preset to open when the liquid in the cooling system has reached a selected temperature whereby heated liquid (e.g., antifreeze/coolant) from engine 12 passes through upper radiator hose 18 to radiator 14. Engine 12 is also typically in communication with heater 16 of the cooling system by means of heater hose 26 and heater hose 28.

Figure 2:
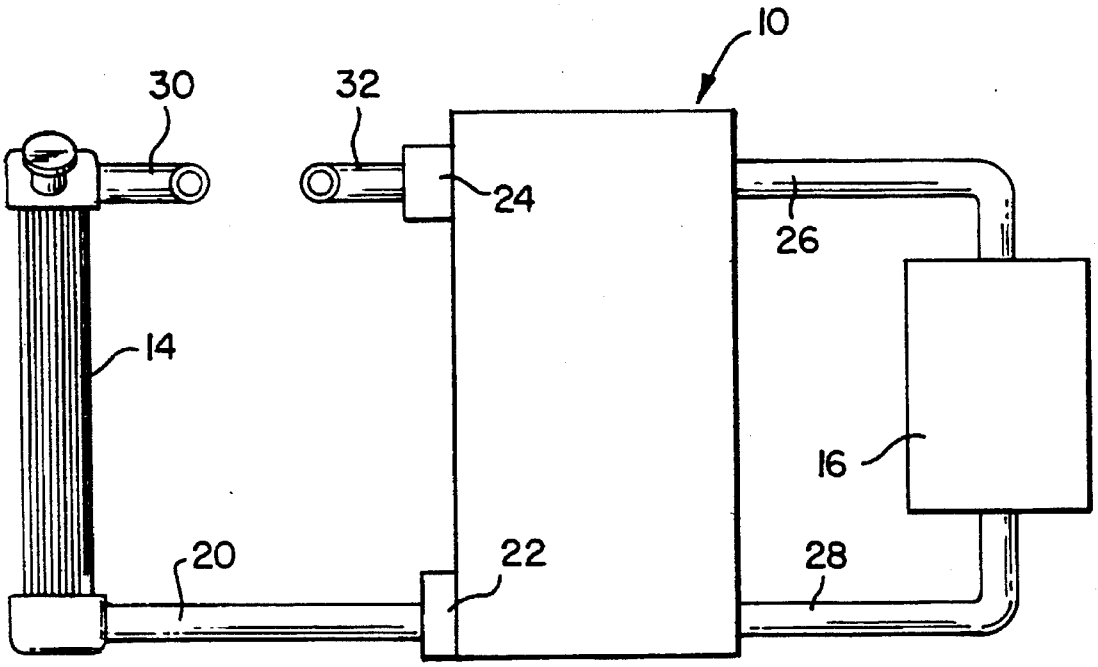
FIG. 2 is a view of the automotive cooling system of FIG. 1 showing the upper radiator hose cut for introduction of the change-over apparatus of this invention.
Figure 3:
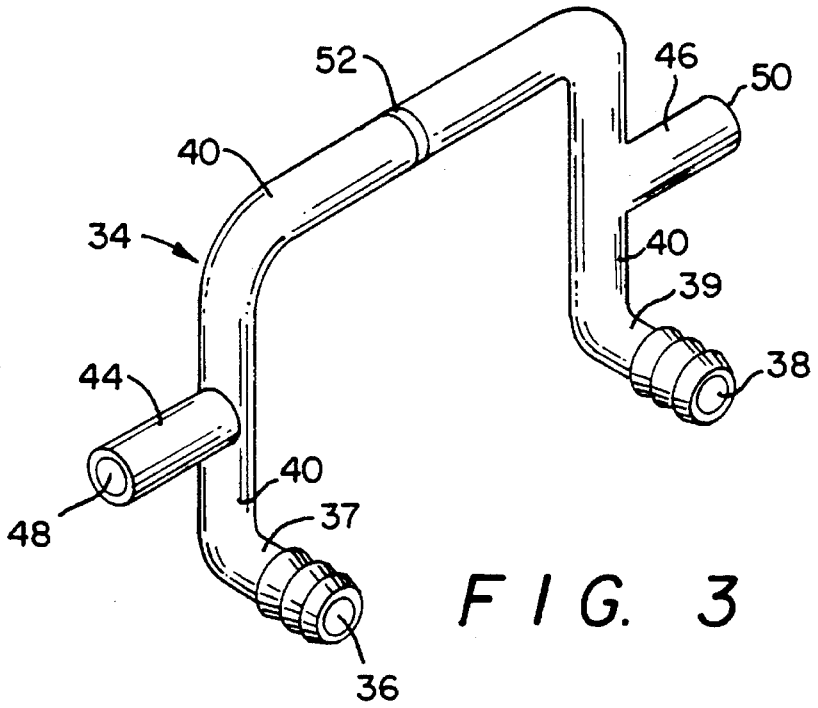
FIG. 3 is a perspective view of one embodiment of a change-over apparatus of this invention.
Figure 4:
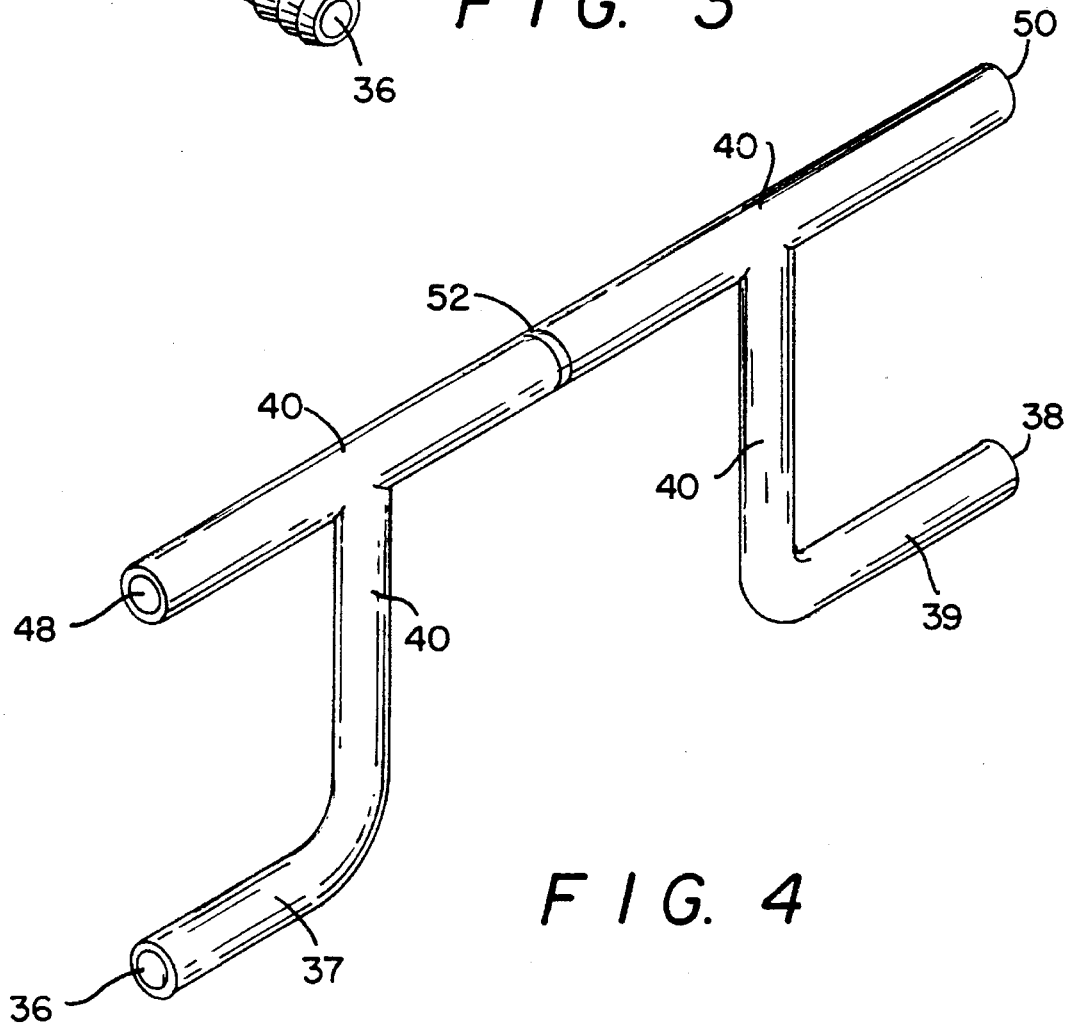
FIG. 4 is a perspective view of another embodiment of a change-over apparatus of this invention.

In FIG. 2 cooling system 10 of FIG. 1 is again depicted except upper radiator hose 18 has been cut to provide upper radiator hose section 30 and upper radiator section 32 for use in attaching the change-over apparatus (shown in FIG. 3 and FIG. 4) to the cooling system. FIG. 3 shows one embodiment of the change-over apparatus 34 having hollow passages 40, 44 and 46 through which liquid may pass. The passages of liquid into and out of the change-over apparatus is facilitated by means of tube section 37 with first end opening 36, tube section 39 with second end opening 38, liquid ingress opening 48, liquid egress opening 50 and flow regulating means 52. Flow regulating means 52 is any device which may have a permanently closed position (e.g., a fixed barrier to liquid flow) or a device (e.g., a valve device) which is capable of being in an open or closed position. In one embodiment, shown in FIG. 6, the flow regulatory means is provided by employing two unconnected tubular bodies. When flow regulating means 52 is a valve or other device which may be in an open (including partially open) or closed position the valve may be opened to provide for cross-flow via tube 40 when liquid is no longer being introduced at liquid ingress opening 48. FIG. 4 shows another embodiment of the change-over apparatus 34 wherein hollow tube section 37 and hollow tube section 39 are outwardly turned instead of inwardly turned.

Figure 5:
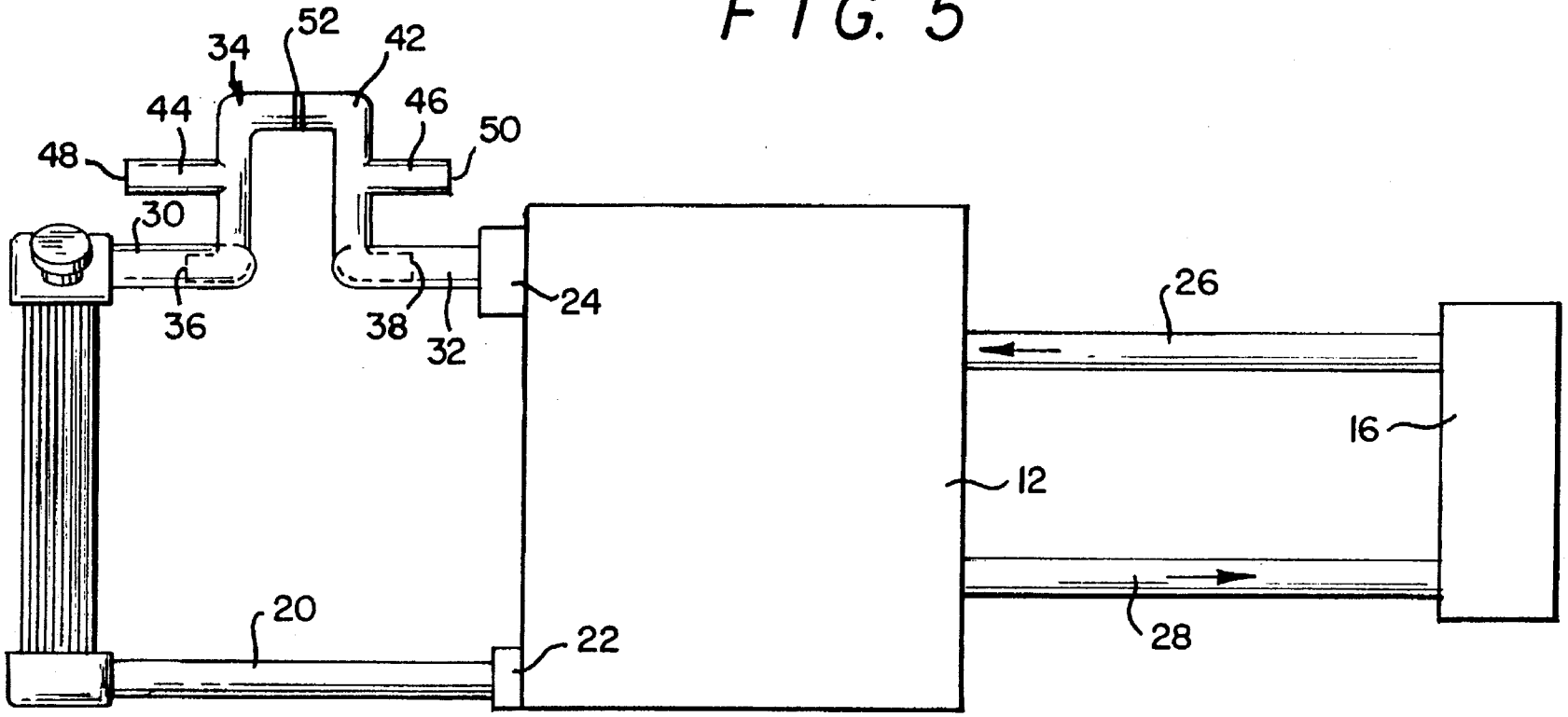
FIG. 5 is a view of an integrated flush and fill process for an automotive cooling system.

Referring to FIG. 5, change-over apparatus 34 is shown attached to cooling system 10 wherein tube section 37 has been inserted into upper radiator hose section 30 and tube section 39 has been inserted into upper engine hose section 32. It may be advantageous in some circumstances to provide clamping means (not shown) on the outside surfaces of upper radiator hose sections 30 and upper engine hose section 32 to assume that liquid tight contact is made between the hose sections and the hollow tube sections 37 and 39 of the change-over apparatus. As noted above, the engine of the automobile is not running during the period that radiator hose 18 is cut and change-over apparatus 34 is attached to the cooling system as above described. After change-over apparatus 34 has been combined with the cooling system a source of liquid ("second liquid") is attached to liquid ingress tube opening 44 whereby a liquid is introduced through liquid ingress opening 48. The liquid to be introduced through liquid ingress opening 48 is preferably new antifreeze/coolant having an ethylene glycol (including minor amounts of diethylene glycol) content between about 30 weight percent and about 70 weight percent. Alternatively, the liquid may be a flushing liquid containing a flushing agent. For example, the flushing liquid may be water and may contain flushing agents such as oxalic acid, citric acid and/or other cleaning agents such as surfactants. After the source of liquid (not shown) is attached to liquid ingress tube 44 the introduction of the second liquid is commenced as the engine is started so that water pump 22 provides a movement of the liquid ("first liquid") in cooling system 10 whereby the second liquid introduced through liquid ingress opening 48 through ingress tube 44 passes through tube 40 to tube 37 and out first opening 36 to upper radiator tube section 30 into the top of radiator 14. The first liquid in cooling system 10 is now displaced as the action of water pump 22 serves to pump the second liquid into cooling 10 system as it pumps the first liquid out of cooling system 10 through liquid egress opening 50 to collection means (not shown). As the engine is running the first liquid enters through upper radiator hose section 30, in a down-flow direction through radiator 14, through lower radiator hose 20 to water pump 22 through engine 12 to heater hose 28 and heater 16 and then returns to the engine through heater hose 26. The second liquid in the engine continues through the engine until it has displaced the first liquid, e.g., used antifreeze/coolant, originally in the engine and enters upper radiator tube 32. During the progression of the second liquid introduced through ingress opening 48 through the cooling system, the first liquid originally in the cooling system has been displaced by means of water pump 22 whereby the first liquid passes through the cooling system to second opening 38 of change-over apparatus 34 through tube 39 to egress tube 46 and out egress hole 50 to a collection means 50 (not shown). During the above introduction of the second liquid to the cooling system the flow of the second liquid through tube 40 and tube 42 is prevented by flow regulation means 52 which is in a closed position. Flow regulation means 52 may be a fixed barrier which permanently prevents the flow of liquid between tube 40 and tube 42 whereby the second liquid being introduced to the cooling system passes into radiator 14 while the first liquid is displaced through liquid egress opening 50. When a selected volume of second liquid has been introduced through liquid ingress opening 48 of the engine is turned off and the flow of liquid into and out of the cooling system is stopped. If flow regulating means 52 is a valve the valve may be opened and screw caps (not shown) or other closure means used to seal liquid ingress opening 48 and liquid egress opening 50. The change-over apparatus 34 may then be left as an integral part of cooling system 10 until it is used for another change-over process. Alternatively, the formation of a new flow passageway (such as radiator hose 18) between engine 12 and radiator 14 may be made by removal of change-over apparatus 34 followed by replacement of radiator hose segments 30 and 32 with a new radiator hose 18. Alternatively, a plastic connector with appropriate clamping may be used to connect radiator hose section 30 to engine hose section 32 to provide for open communication of liquid in the cooling system from engine 12 to the top of radiator 14. Plastic connectors of the type suitable for connecting hose section and engine are well known in the art.

Figure 6A:
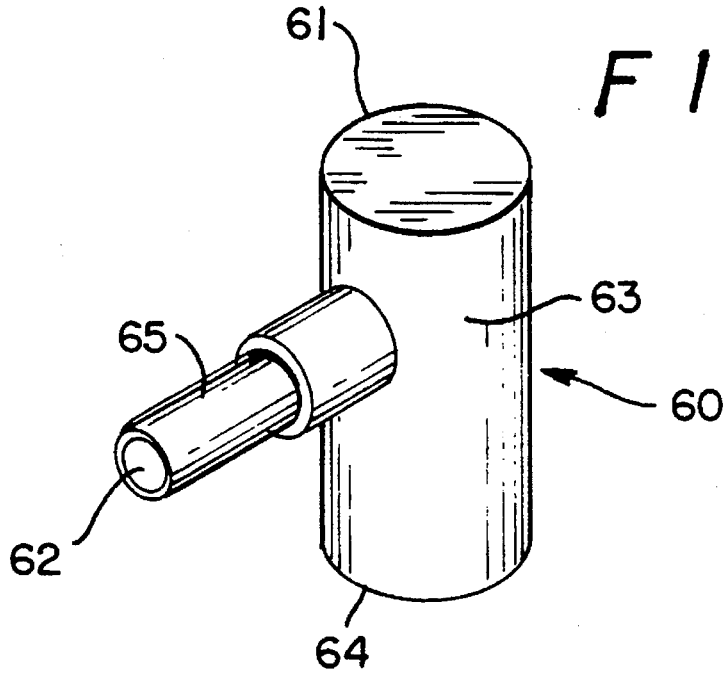
FIG. 6 is a perspective view of one embodiment of a change-over apparatus of this invention.
Figure 6B:
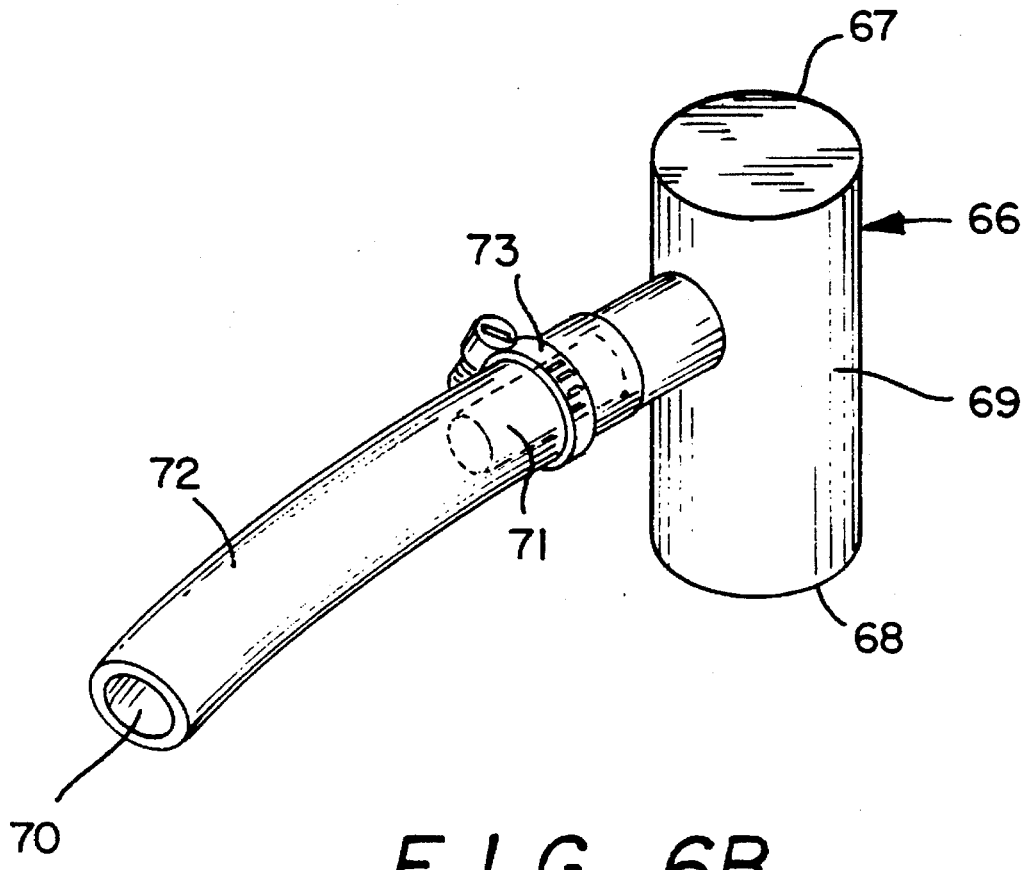

FIG. 6A and FIG. 6B show a further embodiment of the instant invention wherein the change-over apparatus of the instant invention is provided as two unconnected tubular bodies 60 and 66. Tubular body 60 of FIG. 6A is provided with closed end 61 with connector 65 with opening 62 for connection to the upper radiator hose section (not shown) and liquid ingress opening 64 in tubular member 63 for connection to a source of liquid ("second liquid") for introduction to the cooling system. Tubular body 66 of FIG. 6B is provided with opening closed end 67 with connector 71 for connection to the upper engine hose section 72 (shown with clamp 73) for connection to collecting means (not shown) for collection of the liquid ("first liquid") from the cooling system via opening 68 of tubular section 69 as the second liquid displaces the first liquid from the cooling system as the water pump of the cooling system moves liquid in flow direction of the cooling system as the vehicle's engine operates.

The above discussion has referred to the liquid introduced as preferably being an antifreeze/coolant containing between 30 weight percent to about 70 weight percent ethylene glycol. In this embodiment the liquid which displaces the used antifreeze/coolant is the new antifreeze/coolant for the cooling system. Such an embodiment is advantageous in that the volume of liquid from the change-over to be handled is the volume of the cooling system and no additional volume of liquid is created from the use of flushing liquids. Since in some instances it may be desirable to use a flushing liquid with a flushing agent (e.g., oxalic acid or citric acid), the process as described in reference to FIG. 5 may be carried out a number of times using a different liquid each time. For example, the process may just be carried out with the liquid being a flushing liquid, carried out a second time with a neutral liquid such as water and then carried out a third time with a new antifreeze/coolant. In a commercial setting each liquid displaced from the cooling system can be separately collected and either reused or sent to a recycling center.

RECYCLE OF USED ANTIFREEZE/COOLANT

In a further embodiment the instant process includes additional steps as may be beneficial in treating the used antifreeze/coolant displaced from the cooling system. For example, the used antifreeze/coolant may be treated according to the process disclosed in U.S. Ser. No. 07/564,262, filed Aug. 8, 1990, incorporated by reference, and entitled "PROCESS FOR TREATMENT OF AQUEOUS SOLUTIONS OF POLYHYDRIC ALCOHOLS".

The instant discussion is directed to the treatment of spent antifreeze/coolant from the heat exchange systems (commonly referred to as "cooling systems") of internal combustion engines as disclosed in the aforementioned patent application. The process is useful in purifying a wide range of contaminated aqueous ethylene glycol composition including used antifreeze/coolant from cooling systems of internal combustion systems.

The term "heat exchange system" is employed herein to include any heat exchange system and includes cooling systems for internal combustion engines, as commonly employed in automobiles, trucks, motorcycles, airplanes, trains, tractors, generators, compressors and the like. The cooling system in automobiles and trucks are representative of such heat exchange systems for internal combustion engines. Automotive heat exchange systems and their construction are well known in the art and are known to contain several metals, including aluminum and lead solder which with time may be dissolved into the working antifreeze/coolant composition within the cooling system by physical abrasion and/or chemical action. The term "spent antifreeze/coolant" herein refers to an antifreeze/coolant which has operated as the antifreeze and/or coolant for a time in a heat exchange system, including an automotive cooling system.

The term "metals" as used herein in reference to the metal components present in the spent antifreeze/coolant includes metals such as aluminum and magnesium and "heavy metals" such as lead, iron, zinc, manganese, copper and molybdenum. Although aluminum is not a "heavy" metal as that term is understood in the prior art, the term "heavy metal" as used herein is intended to include aluminum as to the metal components present in a spent antifreeze/coolant which are subject to removal by the instant process. Owing to the construction of a cooling system so as to include aluminum surfaces in contact with a working antifreeze/coolant, it is common for the spent antifreeze/coolant to contain aluminum.

The antifreeze/coolant employed in heat exchange systems is generally a mixture of an alcohol (including methanol, ethanol, propanol, butanol, ethylene glycol, diethylene glycol, propylene glycol, dipropylene glycol, glycerol, butene glycol, the monoacetate of propylene glycol, the monoethylether of glycol, the dimethyl ether of glycerol, alkoxy alkanols and mixture thereof); with the preferred alcohols being selected from the group consisting of ethylene glycol, diethylene glycol, propylene glycol, dipropylene glycol and mixtures thereof, and preferably consists of ethylene glycol, water and additional chemical components which provide corrosion protection or other beneficial function for the particular heat exchange system(s) wherein it is employed. Further, it is well known that up to about 10% diethylene glycol or higher may be present in the grade of ethylene glycol employed to manufacture antifreeze/coolants for cooling systems.

Owing to the wide spread use antifreeze/coolants in internal combustion engine cooling systems based upon ethylene glycol/water mixtures, the treatment process of U.S. Ser. No. 07,564,262 is particularly useful in conjunction with ethylene glycol-based antifreeze/coolants heretofore employed as heat exchange fluids for the cooling systems of internal combustion engines. Such ethylene glycol-based antifreeze/coolants representative of such antifreeze/coolant compositions are those containing silicone/silicate additives and/or various carboxylic acids as corrosion inhibitors for the automotive cooling systems. Other optional additives are typically employed in commercial antifreeze/coolants in minor amounts of less than 50 wt. percent based on the weight of the antifreeze/coolant. Typical optional additives included in antifreeze/coolants include, for example, known corrosion inhibitors for aluminum or other metals in admixture with the oils and the hydrophobizing agents of the present invention such as, for example, molybdates, mono and/or di-aliphatic acids, e.g., sebacates, carbonates, silicates, alkali metal nitrates, alkali metal nitrites, diisopropylamine nitrite, dicyclohexylamine nitrate, tolyltriazole, mercaptobenzothiazole, benzotriazole, zinc compounds, calcium compounds, phosphates, benzoates, and the like, or mixtures thereof. Further, one or more of the known inhibitors for various metals are in an "inhibitory effective amount" i.e. an amount sufficient to provide a measurable amount of corrosion inhibition with respect to the metal (e.g., copper, steel, brass, aluminum, cast iron, solder, etc.) surfaces to be protected as compared to the corrosion protection provided by the antifreeze/coolant without these inhibitors. Other optional additives that may be present in commercial antifreeze/coolants include: wetting agents and surfactants such as, for example, known ionic and non-ionic surfactants such as the poly(oxyalkylene) adducts of fatty alcohols; defoamers and/or lubricants such as the well-known polysiloxanes and the polyoxyalkylene glycols; wear inhibitors, such as the zinc dithiophosphates and the zinc thiocarbamates; lubricants, such as silicone pump lubricants; and other ingredients known in the art of antifreeze/coolants that do not adversely affect the antifreeze/coolant characteristics sought to be achieved by the end use of the antifreeze/coolant.

Representative antifreeze/coolant compositions based upon polyhydric alcohols which may be treated after use in a heat exchange system, i.e., when collected after use (e.g., a "spent" antifreeze/coolant from an automotive cooling system) include, but are not limited to, those described in U.S. Pat. Nos. 4,664,833, 4,287,077, 4,725,405, 4,704,220, 4,684,474, 4,685,475, 4,687,590, 4,701,277, 4,561,990, 4,578,205, 4,584,119, 4,587,028, 4,588,513, 4,592,853, 4,629,807, 4,647,392, 4,657,689, 4,759,864, 4,851,145, 4,810,406 and 4,345,712; the aforementioned patents incorporated herein by reference. In the aforesaid patents are disclosed combinations of chemical components effective in protecting the metal surfaces of such cooling systems, such being generally referred to as corrosion inhibiting agents.

The spent antifreeze/coolant mixtures obtained by removal from heat exchange systems of internal combustion engines are generally characterized as containing ethylene glycol or other polyhydric alcohol(s) and are typically a mixture containing between about 95 volume percent and about 5 volume percent ethylene glycol and/or other polyhydric alcohol, preferably between about 30 volume percent and about 70 volume percent. The actual amount of ethylene glycol and/or other polyhydric alcohol present in the antifreeze/coolant will depend on several factors. For example, during the "change-over" of an antifreeze/coolant in the cooling system of an internal combustion engine the cooling system will be emptied and the removed antifreeze/coolant placed in a collection container. The cooling system will typically then be flushed with water and/or water with a minor amount of a cleaning agent. This substantially water solution will typically be emptied into the same holding container as the original spent antifreeze/coolant and, thus, further decrease the ethylene glycol concentration in liquid mixture to be recycled. Further, the spent antifreeze/coolant is typically characterized as containing at least one heavy metal selected from the group consisting of lead, iron, zinc, manganese, copper, molybdenum, and aluminum and various organic oils from the internal combustion engine or present as a result of contamination after removal of the antifreeze/coolant.

The antifreeze/coolant will also typically contain one or more organic compounds other than the polyhydric alcohol(s) component. Such organic compounds may be present as a result addition as a functional additive to the original antifreeze/coolant or may be present as a degradation product of the polyhydric alcohol, e.g., ethylene glycol, or other organic compound present in the original antifreeze/coolant. For example, it is well known that under the working conditions that an antifreeze/coolant experiences in an automotive cooling system that thermal degradation of ethylene glycol and other organic compounds present in the working antifreeze/coolant will result in the presence of organic degradation products. Typical organic degradation products of ethylene glycol include, but are not limited to, formic acid, glycolic acid and acetic acid. Antifreeze/coolants also are known to contain inorganic components as corrosion inhibitors including, but not limited to, silicate, nitrate, nitrite, silicone compounds, phosphate, chloride, sulfate, carbonate and mixtures thereof, and salts commonly found in water.

In one embodiment the polyhydric alcohol- containing compositions are taken from a heat exchange system, preferably the cooling system of an internal combustion engine, and contains between about 5 weight percent and about 95 weight percent polyhydric alcohol, preferably ethylene glycol, containing at least one heavy metal and typically containing an oil component. The instant process generally comprises the steps of:

(i) adjusting the pH of said polyhydric alcohol-containing composition to between about 4.0 and about 7.5 by addition of an effective amount of an pH adjusting agent to form a pH-adjusted composition; and (ii) adding an effective amount of a precipitating agent for at least one heavy metal and/or oil component present in the pH-adjusted composition.

In addition to the above steps the instant treatment process also may include one or more of the following steps:

(iii) preferably also includes adding to the pH-adjusted composition of step (ii) an effective amount of a coagulating agent and an effective amount of a flocculating agent effective in forming a precipitate containing at least one heavy metal;

(iv) passing the pH-adjusted composition through a first filtration means to remove a major amount of said heavy metal-containing precipitate;

(v) passing the pH-adjusted composition after the first filtration means through an organic separation means effective in removing organic compounds (other than the polyhydric alcohol(s)) from the pH-adjusted composition;

(vi) passing the pH-adjusted composition from the first filtration means through a second filtration means effective in the physical separation of particles of a smaller size that said first filtration means;

(vii) passing said pH-adjusted composition through a third filtration means having an effective physical separation of particles by size smaller than said second filtration means; and (viii) passing said pH-adjusted composition after filtration through an ion exchanger (anion and/or cation) effective in the removal of at least one solubilized heavy metal from said pH-adjusted composition.

Prior to addition of the precipitating agent the pH of the spent antifreeze/coolant (typically having a pH between about 8.0 and about 10.0) is adjusted by addition of an effective pH-adjusting agent to adjust the effective pH to improve the precipitation of heavy metal(s) and is preferably adjusted to a pH between about 4.0 and about 7.5 and more preferably between about 4.5 and 7.0. This pH adjustment improves the precipitation of heavy metals present in the spent antifreeze/coolant while concurrently adjusting the pH at a sufficiently high pH so as to minimize acidic solubilization of heavy metal compounds. The pH-adjusting agent may be any organic or inorganic compound which effectively adjusts the pH to the selected pH, although it has been unexpectedly found that the use of nitric acid as the pH-adjusting agent in conjunction with the use of aluminum nitrate as the precipitating agent provides unexpected results for precipitating both solubilized and insoluble lead species and for removing oil components present in spent antifreeze/coolant from the cooling systems of internal combustion engines. Organic acids, acidic organic salts, inorganic acids and acidic inorganic salts are employable herein being effective in adjusting the pH of the antifreeze/coolant. Representative acids include nitric acid, phosphoric acid, sulfuric acid, hydrochloric acid, carboxylic acids, mixtures thereof and the like. It has been observed that salts useful as both pH-adjusting agents and/or precipitating agents include the following representative acidic salts: the chlorides and nitrate salts of calcium, magnesium, zinc, aluminum and iron; the sulfate salts of magnesium, zinc, aluminum and iron; and the like. It is beneficial to employ nitric acid as the pH-adjusting agent so as to prevent the introduction of corrosive anions and/or anions which may interfere with precipitation of heavy metals present in the spent antifreeze/coolant during the pH adjustment step, although the concurrent adjustment of pH and precipitation of heavy metal(s) with an acidic salt, e.g., preferably an aluminum nitrate hydrate such as $A1(NO_3)_3.9H_2O$, is within the scope of the instant invention.

The precipitating agent may be selected to provide for the formation of heavy metal(s) precipitate in the pH-adjusted antifreeze/coolant. The precipitating agent need not result in the actual formation of a solid precipitate if a coagulant and/or flocculant are to be employed but only need render heavy metal(s) and/or oil present in the spent antifreeze/coolant susceptible to precipitation in the presence of coagulant and flocculant. When the precipitating agent is employed without the use of a coagulant and/or flocculant, it has been observed that the rate of formation and separation of the precipitate may be too slow for effective commercial use of the process, although the benefits of instant process will nonetheless be achieved. The precipitating agent is added in an effective amount to precipitate a selected amount of heavy metal(s) present in the spent antifreeze/coolant. As aforementioned, the heavy metals most commonly found in spent antifreeze/coolant are lead (Pb from lead solder corrosion), iron (Fe from water and radiator corrosion), zinc (Zn from metal corrosion and from zinc salts employed in antifreeze/coolants), copper (from radiator corrosion) and aluminum from corrosion (water pump, radiator, engine head and engine). It has been observed that the concentrations of solubilized lead and iron in a spent antifreeze/coolant are on the order of up to about 100 parts per million (ppm) lead, and up to about 25 ppm iron, respectively. It has also been observed that insoluble lead components may be present in concentrations up to about 150 ppm and insoluble iron components may be present in concentrations up to about 600 ppm. Typically total concentrations of lead and iron are set forth in Table A, hereinbefore. The effective amount of precipitating agent for such concentrations of Pb and Fe will typically be between about 100 ppm and about 6000 ppm (based upon use of $A1(NO_3)_3.9H_2O$ as the precipitating agent) and preferably between about 500 ppm and about 5000 ppm. The effective amount of precipitating agent employed is related to the equivalents of heavy metal(s) to be precipitated and will vary depending upon the equivalents of the selected precipitating agents useful herein for forming heavy metal precipitates.

As aforementioned, selection of the precipitating agent may be from that group of organic and/or inorganic compounds effective in the formation of a substantially insoluble species of at least one heavy metal present in the spent antifreeze/coolant at the adjusted pH and may include salts of heavy metal(s) such as phosphates, chlorides, sulfates, oxalates and the like. The term "substantially insoluble" is meant to refer to a heavy metal species which will form as one or more precipitable species at a pH between about pH 4.0 and pH 7.5. Surprisingly, it has been found that use of aluminum nitrate ($Al(NO_3)_3.9H_2O$) as a precipitating agent for lead after pH adjustment (to between about 4.0 and about 7.5) of the antifreeze/coolant with nitric acid (as the pH-adjusting agent) is particularly advantageous for use in formation of a lead precipitate and is also most beneficial for use in forming a precipitation with the additional use of a coagulant and/or flocculant. The exact mechanism by which aluminum nitrate beneficially provides for formation of a precipitate of lead is not fully understood but may relate to chemical reaction with lead and/or may involve physical adsorption of lead species on the surface of aluminum, hydroxide or an aluminum oxide or other aluminum species formed in situ by addition of aluminum nitrate.

The selection of the coagulant and flocculant is correlated to the alcohol-based antifreeze/coolant being treated and is made to provide for effective precipitation and filtration of the precipitate and separation of the precipitate by a mechanical filter. The coagulant may be any of the well known commercially available coagulants including Calgon 2466, Cyanamid 572C, mixtures thereof and the like. The flocculant may be any of the well known commercially available flocculants including PRIMAFLOC® C-3, MAGNIFLOC® 572C, Calgon 7736, Cyanamid 1820A, mixtures thereof and the like. Calgon POL-E-Z® 2466 is a high molecular weight, high charge cationic polyelectrolyte available from Calgon Corporation. PRIMAFLOC® C-3 is a cationic polyelectrolyte flocculant characterized as a water-soluble polyamine (29–31%) and is available from Rohm and Haas Company. Calgon POL-E-Z® 7736 is a high molecular weight, anionic polyelectrolyte available from Calgon Corporation. MAGNIFLOC® 572C (flocculant) is a very low molecular weight, liquid cationic flocculant available from American Cyanamid Company. Cyanamid 1820A is a cationic flocculant available from American Cyanamid Company. The selection of coagulants and flocculants for precipitating solids in water based systems is well known as evidenced by the discussion in "The Nalco Water Handbook" Second Edition, (ISBM 0-07-045872-3), 1988, at Part 2, Chapter 8 at pages 8.3 to 8.23, incorporated herein by reference.

In one embodiment the antifreeze/coolant is a spent antifreeze/coolant from the cooling system of an internal combustion engine, typically from an automobile or truck, having its pH adjusted to between about 4.5 and about 7.0 with nitric acid as the pH-adjusting agent, followed by treatment with an effective amount of aluminum nitrate as the precipitating agent, followed by addition of coagulant, preferably Calgon 2466, and flocculant, preferably Calgon 7736. The effective amount of coagulant is typically between about 75 ppm and about 300 ppm, preferably between about 150 ppm and about 225 ppm. The effective amount of flocculant is typically between about 25 ppm and about 300 ppm and preferably between about 50 ppm and about 100 ppm. It has been observed that there is an effective concentration range of coagulant and flocculant in the coagulant and flocculant solutions when such are to be added to the antifreeze coolant after such has been treated with the pH-adjusting agent and the precipitating agent. Surprisingly, it has been found that commercially available coagulants and flocculants are sold at concentrations significantly greater than beneficially suitable for use in the instant process. For example, when treatment of a lead-containing automotive antifreeze/coolant is effected with Calgon 2466 as the coagulant and Calgon 7736 as the flocculant after the antifreeze/coolant has been treated with effective amounts of nitric acid and aluminum nitrate, it has been observed that the coagulant and flocculant as commercially available should be beneficially diluted from its original commercial concentration by the addition of water or other suitable solvent. For example, suitable dilution of coagulant Calgon 2466 and flocculant Calgon 7736 for use in the instant invention may be prepared by mixing 100 parts (by weight or by volume) of the coagulant or the flocculant with water to form up to 40,000 parts of coagulant or flocculant solution for use in the instant invention. The aforementioned water diluted mixtures will preferably result in effective concentrations of coagulant or flocculant in the resulting diluted water mixtures wherein the concentration of coagulant or flocculant is 0.25% to 5.0% of the concentration of the original commercial concentration of the coagulant or flocculant. Although the exact reason for the beneficial effect obtained by use of a diluted coagulant or flocculant and the beneficial correlation of the concentration of the coagulant and flocculant to the antifreeze/coolant is not fully understood it has been observed that such may be related to the unique chemical environment resulting from the use of an originally formulated ethylene-glycol based antifreeze/coolant in the cooling system of an internal combustion engine and from localized concentrations of coagulant or flocculant resulting from the inherent difficulty in mixing large volumes of liquids. The actual correlation in the concentration is believed to result in an effective concentration of coagulant and flocculant, as described above based upon the range of the heavy metals observed to be present in antifreeze/coolant removed from automotive cooling systems.

The antifreeze/coolant will form a solids phase (precipitate) and a liquid phase after treatment with the pH-adjusting agent and precipitating agent and in a further embodiment preferably treatment as to coagulant and flocculant, as described above. The precipitate may be removed by mechanical filtration. In addition, it has been observed that proper agitation of the treated antifreeze/coolant enables skimming of precipitate from the top of the treated antifreeze/coolant as some portion of the precipitate is present at the surface of the treated antifreeze/coolant. Further, it has been observed that recirculation of the spent antifreeze/coolant in the mixing tank by introduction of the recirculated stream above the surface of the antifreeze/coolant in the mixing tank is beneficial in forming a precipitate suitable for skimming as compared to the form of the precipitate formed when the recirculated stream is introduced below the surface of the antifreeze/coolant in the mixing tank. Accordingly, it is preferred to have a recirculation of the spent antifreeze/coolant in the mixing tank from below the surface of the antifreeze/coolant in mixing tank to a position sufficiently above the surface so as to expose the recirculated antifreeze/coolant to air whereby some degree of contact with air occurs, such having been observed as effective in improving the form of the precipitate for skimming. This preferred recirculation is preferably commenced prior to the addition of the pH adjusting agent and precipitating agent. It has been observed that the use of a process step wherein skimming of the surface of the treated antifreeze/coolant is employed is beneficial in reducing the amount of precipitate which must be removed by filtration. This reduction in the amount of precipitate to be removed by filtration both increases the rate at which the treatment process may be carried out and increases the useful life of the filtration means, thus decreasing the number of times the filtration means must be replaced. The effective particle size removed by the filtration means will depend in part on whether a single or multiple filtration steps are to be employed. If a single filtration step is to be employed the filtering means will preferably remove particles having a particle size greater than about 50 microns, although use of a single filtration step is not employed. If this first filtration is the first filtration means in a series of filtration means, then this first filtration means will preferably be effective in the removal of particles having a particle size greater than about 100 microns. In one embodiment it has been found to be beneficial to employ at least three filtration steps wherein the first filtration means is effective in removing species larger than about 100 microns, a second filtration means effective in removing species larger than about 40 microns and a third filtration means is beneficially employed wherein such is effective in removing species larger than about 5 microns. An optimal fourth filter may be employed wherein such fourth filtration means is effective in removing species larger than about 0.2 microns, preferably larger than about 0.1 microns. Mechanical filtration means having effective filtration sizes as above discussed are well known in the prior art. Optionally, as herein described, an organic separation filter may be provided in conjunction with the previously discussed mechanical filters.

In a further embodiment, the treated, filtered, spent antifreeze/coolant is passed through an active filter for the removal of organic compounds, e.g., oils, aldehydes and organic acids. Representative of such active filters are the various activated carbon filters sold under the tradename Fulflo by Parker Hannifin Corporation-Commercial Filters Group or a No. 2 Anthacite filter sold by Penfield Liquid Treatment. The Fulflo filter is characterized by its honeycomb filter structure having an activated carbon surface while the Penfield filter is a loosely packed carbon filter. The active carbon filter acts as an organic separation means effective in the selective removal of organic compounds from the polyhydric alcohol/water mixture forming spent antifreeze/coolant.

It has been found beneficial to provide two or more filtration means for the spent antifreeze/coolant (either before or after aforementioned organic separation means) to effectively remove materials greater than about 5 microns, and more preferably to remove materials greater than about 0.2 microns. It has been found that the use of one or more additional mechanical filtration steps in conjunction with a first filtration means step is most advantageous in the separation of bulky organic and inorganic compounds and both large and small particulate solids. Further, by providing a series of ever smaller size filters the likelihood of clogging smaller pore filters with larger materials is effectively eliminated. In one embodiment the process employs a first filtration means effective in removing materials greater than about 100 microns, a second filtration means effective in removing materials greater than about 40 microns, a third filtration means effective in removing materials greater than about 5 microns, and a fourth filtration means effective in removing materials greater than about 0.2 microns.

In a further embodiment the process may also involve treatment with at least one ion-exchange resin to remove solubilized species present in the spent antifreeze/coolant. A possible result of the initial pH-adjustment of the instant process is the formation of solubilized cationic and/or anionic species of one or more heavy metals. The pH-adjustment to a pH between about 4.0 and about 7.5 is selected so to minimize the formation of such solubilized cationic and/or anionic species of such heavy metals, especially solubilized lead species. Although it has been observed that no such solubilized cationic species (less than the lowest measurement limit of 2 ppm), e.g., solubilized lead, are present after the addition of the pH-adjustment agent, precipitating agent, coagulant and flocculant it is believed to be beneficial to treat the filtered, spent antifreeze/coolant with a cation and/or anion exchange resin to assure that essentially no solubilized heavy metal is present. It has also been observed that such ion exchangers also may act as filtration means for effectively removing materials having a size greater than about 2.0 microns. Further, since some solubilized species will pass through filtration means having a pore size greater than 0.005 and remain as solubilized species it is beneficial to employ an ion exchange material whereby such species are selectively removed by other than physical separation.

It is desirable to remove any solubilized heavy metals from the spent antifreeze/coolant so that such may be properly handled and properly disposed. Accordingly, the filtered, spent antifreeze/coolant may be treated with a cation exchange and/or anion exchange resin effective in the removal of solubilized heavy metal cation(s), or anions. Cation exchange resins useful in the removal of solubilized heavy metal cations include well known cation exchange resins such as Rohm and Haas DP-1, Rohm and Haas Amberlite® IRC-718, Duolite® C-464, Purolite® C-106 and Ionic® CNN. Rohm and Haas Amberlite® IRC 718 is preferred owing to its effectiveness in the removal of solubilized lead and its cost. Amberlite® IRC 718 is a chelating cation exchange resin having a high affinity for heavy metal cations over alkali or alkaline earth metals in the pH range between about 4.0 and about 7.5 and is formed from Dow Chemical Company's SBR resin; a styrene-divinyl benzene material and is available from Rohm and Haas. Anion exchange resins which may be employed herein include Rohm and Hass Amberlite® IRA 400; Purolite A-600; Ionic® ASB-1; and Duolite® A-109. It has been observed that the use of an anion exchange resin may not always be beneficial owing to the high concentration of anions present, present in the treated antifreeze/coolant, e.g., nitrate, in the treated antifreeze. Nevertheless, there may be instances where an anion exchange resin may be beneficially employed, e.g., where the anion exchange resin is selective to one or more anionic species. Further, it is well known that ion exchange resins having both cation and anion exchange characteristics are commercially available and such dual exchange resins may be employed herein. For example the non-exchange media of U.S. Pat. No. 4,908,137, incorporated herein, is believed to be a novel non-exchange media useful herein in the removal of heavy metal ions.

The treatment with the cation and/or anion exchange resin ("ion exchange") may be accomplished after suitable mechanical filtration of the spent antifreeze/coolant after the addition of the pH-adjusting agent, precipitating agent, coagulant and flocculant has resulted in precipitation of insoluble heavy metal compounds. Since the presence of large particulate matter will tend to clog most ion exchange materials, it is preferred that the ion exchange step follow a mechanical filtration step where particles having a size greater than about 5 microns have been removed.

The reference to "filtration means" is meant to designate the various filtration devices hereto known in the prior art for use in the physical separation of materials (including both organic species and inorganic species) based on size. Filtration devices suitable for use in the instant invention are commercially available. For example, the first filtration means of 100 microns and above may be a 3M Brand liquid filter bag formed from polypropylene or stainless steel as described in 3M sales brochure 70-0701-3209-0(201)iii 1989, incorporated herein. The second filtration means having separation means of about 40 microns and above may be a 3M Brand liquid cartridge filter having a pleated polypropylene design as described in 3M sales brochure 70-0702-2790-8(201.5)11, incorporated herein.

In one embodiment the treatment with a cation exchange resin may be replaced in part or in whole with treatment with an anion exchange resin. In some instances the heavy metal(s) may be present or may be converted into an anionic species. In some instances it may be beneficial to treat the spent antifreeze/coolant to form an anionic species of the heavy metal, since in some instances its removal as an anionic species may be more effective than its removal as a cationic species. The formation of such anionic species may be beneficial owing to the desire to increase the reserve alkalinity of the spent antifreeze/coolant in preparation for its reprocessing into a working antifreeze/coolant for use in an automotive cooling system.

The final composition obtained from the various embodiments of the instant invention are characterized as having lower concentrations of one or more heavy metal components and is typically characterized as being an aqueous composition(s) containing between about 5 and about 95 weight percent polyhydric alcohol, preferably ethylene glycol, and containing less than about 5 ppm soluble lead, generally less than 2 ppm soluble lead. These aqueous polyhydric alcohol compositions may be employed in the manufacture of a working antifreeze by addition of corrosion inhibitors hereto employed in the manufacture of antifreeze/coolant compositions or may be employed for other common uses for the polyhydric alcohol.

When the use is for antifreeze/coolant, such corrosion inhibitors will be employed in effective amounts correlated to any residual concentration of components of corrosion inhibitors present from that present in the spent antifreeze/coolant which was not removed by the instant process. For example, solubilized silica and nitrate may be present in the compositions derived from the instant process, since the various steps of precipitation, organics separation and mechanical filtration may not be effective in their complete removal. Chemical analysis of the treated spent antifreeze/coolant will provide a basis for correlating the effective amount of corrosion inhibitor which should be added to the treated aqueous antifreeze/coolant to form an effective working antifreeze. In some instances the formation of a working antifreeze may also require the addition of ethylene glycol or fresh antifreeze or removal of water to obtain a solution having the desired freezing point. Removal of water from the aqueous ethylene glycol may be by distillation, extraction or other known separation means.

The various steps of the instant process may be carried out at an effective temperature wherein the antifreeze/coolant is in a liquid state and is preferably between about 18° C. to about 45° C. and at an effective pressure, preferably between about 0.9 atm to about 1.1 atm, or such other temperatures or pressures as may improve the process.

It has been observed that it is not preferred to pass the precipitate formed by addition of the pH-adjusting agent, precipitating agent, coagulant and flocculant through a high shear mechanical pump, since a high shear mechanical pump tends to form particles of smaller size by mechanical shearing, thus making it more difficult to remove particles with large size filters. Accordingly, it has been found that it is preferred to place a pumping means after the first filtration step which to provide a pulling action after the first filtration means or alternatively, provide a diaphragm or other low shearing type pump ahead of first filtration means. Representative of high shear pumps is a MOYNO® SP Pump (available from Robbins & Wyers, Inc.) and representative of a low shear pump is a Twin Diaphragm Pump (available from the ARO Corporation). It has also been observed that by employing skimming of precipitate from the surface of antifreeze/coolant in the vessel to which the pH-adjusting agent, precipitating agent, flocculant and coagulant are added that sufficient precipitate can be removed to significantly reduce the problems associated with high shear pumps.

The instant treatment process may be carried out in a batch wise or, alternatively, in a continuous mode. When carried out in a batch mode, the process is conducted by placing a selected quantity of spent antifreeze/coolant in a vessel. The pH-adjusting agent and precipitating agent are added followed by addition of the coagulant and flocculant whereby a precipitate will be formed. The contents of the vessel are then filtered by a first filtration means to remove the precipitate from the liquid phase. It has been found advantageous to minimize the mechanical action on the precipitate during this first filtration step so as to minimize the fraction of smaller size particles which form as a result of mechanical abrasion. Such mechanical abrasion may be minimized by manual mixing for about 5 minutes after all ingredients have been added during which time it may be advantageous to skim precipitate from the surface of the mixture. The pH-adjusted composition may then be sequentially passed through one or more filtration means, organic separation means, additional filtration means and ion exchange means.

The treated antifreeze/coolant may be suitable for use as a component of a working antifreeze/coolant without further treatment or may be distilled to remove water and/or organic component and, thus, provide a higher content polyhydric alcohol solution. Alternately, the treatment process is well suited to be carried out in a continuous manner based upon the process steps employed in the batchwise process discussed above.

The holding means may be a storage tank of conventional design with inlet and outlet ports for introduction of the original spent or recirculated antifreeze/coolant and the treated antifreeze/coolant, respectively. A mechanical mixing or stirring means is typically employed to mix the contents of the holding means. The pH adjusting means and addition means may be any liquid or dry addition apparatus for introduction of the pH adjusting agent, precipitating agent, coagulant and/or flocculant. The pumping means may be any device effective in transferring the contents of the holding means to another process step or to another storage area, including displacement by the force of gravity. The mechanical separation means and organic separation means may be one or more filters as described in the instant application with reference to the instant process. The cation exchange means may be one or more of the cation and anion exchange resins described herein.

In addition to the above recycle apparatus it has been observed that it may be beneficial to employ skimming means and recirculating means in combination with the holding means, pH adjusting means and addition means. According to this embodiment the recycle apparatus comprises:

(i) holding means into which a spent antifreeze/coolant may be placed;

(ii) recirculating means for circulating spent antifreeze/coolant in said holding means from a point below the surface of said spent antifreeze/coolant to a point above the surface of said spent antifreeze/coolant, whereby the recirculated spent antifreeze/coolant contacts ambient air prior to its recirculation into said spent antifreeze/coolant;

(iii) pH adjusting means for adjusting the pH of the spent antifreeze/coolant in said holding means;

(iv) addition means for introducing into said holding means at least one of a precipitating agent, a coagulant and a flocculant;

(v) skimming means for removing solids from the surface of said spent antifreeze/coolant in said holding means; and (vi) may optionally contain one or more of mechanical separation means, organic separation means and ion exchange means, as discussed above.

What is claimed:

1. A process for the change-over of a first liquid in a cooling system of a vehicle with a second liquid where said second liquid displaces said first liquid, said cooling system having an engine with a water pump and a thermostat and having a radiator, having an upper radiator hose section connected to said radiator and an upper engine hose section connected to said engine wherein said process consists essentially of:

a) providing a volume of said second liquid to said upper radiator hose section while said engine is running;

b) providing liquid collecting means at said upper engine hose section while said engine is running; and c) running said vehicle having said cooling system until a volume of said second liquid has displaced a volume of said first liquid from said cooling system to said collection means solely by action of the water pump.

2. A process according to claim 1 wherein an additional step comprises:

d) turning off the engine and connecting said upper radiator hose section and said upper engine hose section with connecting means to provide for flow of said liquid in said cooling system from said engine through said upper engine hose section through said upper radiator hose section to said radiator.

3. A process according to claim 2 wherein said connecting means is a hollow connecting tube having two ends wherein one end is connected to said upper radiator hose section and one end is connected to said upper engine hose section.

4. A process according to claim 1 comprising the additional step of:

d) treating said first liquid in said collection means, said first liquid containing between about 5 weight percent and about 95 weight percent of a polyhydric alcohol and containing at least one heavy metal by:

(i) adjusting the pH of said second liquid to between about 4.0 and about 7.5 by addition of an effective amount of a pH adjusting agent to form a pH-adjusted composition and adding thereto an effective amount of a precipitating agent for said heavy metal.

5. A process according to claim 4 wherein said process comprises the following additional steps:

(ii) adding to the pH-adjusted composition an effective amount of coagulating agent and an effective amount of a flocculating agent to form a precipitate containing at least one heavy metal; and (iii) passing the pH-adjusted composition through a first filtration means to remove heavy metal-containing precipitate from said pH-adjusted composition.

6. A process according to claim 5 wherein said process comprises the following additional steps of:

(iv) passing said pH-adjusted composition of step (iii) through a second filtration means having an effective physical separation of greater than about 40 microns;

(v) passing the pH-adjusted composition from step (iv) through an organic separation means effective in removing organic compounds other than said polyhydric alcohol from said pH-adjusted composition;

(vi) passing said pH-adjusted composition through a third filtration means having an effective physical separation of greater than about 0.2 microns;

(vii) passing said pH-adjusted composition of step (vi) through an ion exchange means effective in the removal of at least one solubilized heavy metal present in said pH-adjusted composition; and (viii) adding to said pH-adjusted composition of step (vii) an effective amount of at least one corrosion inhibiting agent.

7. A process according to claim 4 wherein said process comprises the following additional steps.

(ii) adding to the pH-adjusted composition an effective amount of coagulating agent and an effective amount of a flocculating agent to form a precipitate containing at least one heavy metal; and (iii) skimming a portion of said precipitate from said final pH adjusted composition of step (ii).

8. A process according to claim 4 wherein said first liquid is a heavy metal-containing ethylene glycol-containing antifreeze/coolant taken from the cooling system of an internal combustion engine.

9. A process according to claim 8 wherein said first liquid has a pH between about 8.0 and about 10.0 and said heavy metal is lead.

10. A process according to claim 9 wherein said ethylene glycol is present in an amount of between 30 and about 70 volume percent.

11. A process according to claim 8 wherein said cooling system is an automotive cooling system and said heavy metal is at least one heavy metal selected from the group consisting of lead, molybdenum, iron, zinc and copper.

12. A process according to claim 4 wherein said polyhydric alcohol is selected from the group consisting of ethylene glycol, diethylene glycol, propylene glycol, dipropylene glycol, glycerol, butene glycol, the monoacetate of propylene glycol, the monoethylether of glycerol, the dimethyl ether of glycerol, alkoxy alkanols and mixtures thereof.

13. A process according to claim 12 wherein said polyhydric alcohol is selected from the group consisting of ethylene glycol, diethylene glycol, propylene glycol and mixtures thereof.

14. A process according to claim 4 wherein the pH in step (i) is adjusted to between about 4.5 and about 7.0.

15. A process according to claim 4 wherein the pH-adjusting agent is at least one pH-adjusting agent selected from the group consisting of organic acids, inorganic acids, acidic organic salts, acidic inorganic salts and mixtures thereof.

16. A process according to claim 15 wherein the pH-adjusting agent is selected from the group consisting of nitric acid, phosphoric acid, sulfuric acid, hydrochloric acid, carboxylic acids and mixtures thereof.

17. A process according to claim 16 wherein said pH-adjusting agent is nitric acid.

18. A process according to claim 4 wherein said precipitating agent is selected from the group consisting of chlorides, sulfates, phosphates, aluminum nitrates and mixtures thereof.

19. A process according to claim 5 wherein the flocculating agent is selected from the group consisting of anionic flocculants.

20. A process according to claim 5 wherein the coagulating agent is selected from the group consisting of cationic coagulants.

21. A process according to claim 5 wherein said coagulating agent is present in an amount between about 75 ppm and about 300 ppm and said flocculating agent is present in an amount between about 25 ppm and about 300 ppm.

22. A process according to claim 5 wherein said first liquid contains 5 volume percent to 95 volume percent ethylene glycol, contains up to about 150 ppm lead, said pH-adjusting agent is nitric acid, said precipitating agent is $A1(NO_3)_3 \cdot 9H_2O$ said coagulating agent is present in an amount between about 75 ppm and about 300 ppm, said flocculating agent is present in an amount between about 25 ppm and about 300 ppm.

23. A process according to claim 4 wherein the treated pH-adjusted composition contains less soluble lead as compared to the untreated pH-adjusted composition.

24. A process according to claim 5 wherein said first filtration means has an effective separation for species greater than about 100 microns.

25. A process according to claim 6 wherein:

(a) said first filtration means has an effective physical separation of species greater than 100 microns;

(b) said second filtration means has an effective physical separation of species greater than about 40 microns;

(c) said organic separation means is an activated carbon filter;

(d) said third filtration means has an effective physical separation of species greater than about 5 microns; and (e) said ion-exchange means is a cation exchange means effective in selective removal of at least one heavy metal.

26. The process of claim 1 wherein the vehicle is an automobile.

27. The process of claim 1 wherein the first liquid is used antifreeze/coolant.

28. The process of claim 1 wherein the second liquid is new antifreeze/coolant.

29. The process of claim 1 wherein the first liquid is used antifreeze/coolant and the second liquid is new antifreeze/coolant.

* * * * *